United States Patent [19]

Cloward

[11] Patent Number: 4,730,801

[45] Date of Patent: Mar. 15, 1988

[54] SURGICAL ARM REST

[75] Inventor: Ralph B. Cloward, Honolulu, Hi.

[73] Assignee: Surgical Equipment International, Inc., Honolulu, Hi.

[21] Appl. No.: 876,477

[22] Filed: Jun. 20, 1986

[51] Int. Cl.[4] ..... B68G 5/00

[52] U.S. Cl. ..... 248/118; 5/431; 128/77; 269/328

[58] Field of Search ..... 248/118; 128/77; 269/328; 5/431, 424, 436, 437

[56] References Cited

U.S. PATENT DOCUMENTS

| | | | |
|---|---|---|---|
| 2,266,230 | 12/1941 | Mazzeo et al. | 269/328 X |
| 3,345,656 | 10/1967 | Steinman | 248/118 X |
| 3,926,181 | 12/1975 | Eischen, Sr. | 5/436 X |
| 4,210,317 | 7/1980 | Spann et al. | 5/431 X |
| 4,259,949 | 4/1981 | Axelsson | 248/118 X |

*Primary Examiner*—J. Franklin Foss
*Assistant Examiner*—David L. Talbott
*Attorney, Agent, or Firm*—Lyon & Lyon

[57] ABSTRACT

A surgical arm rest is disclosed which cushions, supports and protects a patient's arm during surgery on the patient when in the prone position. The arm rest comprises an elongated member having a first end and a second end, with ridges defining a channel formed between the first and second ends which accepts the arm of the patient. The elongated member is tapered from the first end to the second end. The arm rest may be formed from a polyurethane foam or the like. A section is cut into the side of the arm rest to permit access to the patient's anticubical fossa by anesthesiologists and to permit the arm rest to fold at the elbow. The inside ridge at the lower section of the arm rest may also be cut away to permit access by the anesthesiologists to the forearm, wrist and hand of the arm of the patient.

6 Claims, 4 Drawing Figures

SURGICAL ARM REST

BACKGROUND OF THE INVENTION

1. Field of the Invention

The present invention relates to surgical rests and supports for cushioning and supporting portions of a patient's anatomy during surgery and other medical procedures.

2. The Problem Addressed by the Invention

When surgery is performed on a patient in the prone position, the patient's arms should be supported and cushioned to prevent injury which may occur through pressure on nerves, muscles, tendons, and ligaments due to the weight of the arms. For example, if the shoulders are allowed to droop during a long operation (many back operations last four hours and longer), this could cause numbness in the hands and possibly a bilateral wrist drop. Pressure on the ulnar nerve at the elbow can cause compression ulnar nerve palsy. Devices for supporting the arms of the patient should, however, allow access to anesthesiologists for insertion or attachment of intravenous needles, tubes, and monitoring equipment. In the past, numerous attempts have been made to solve this problem, from simply allowing the patient's arms to rest on the surgical table's cushions adding blankets or other soft material to the table's cushions. These have all proven unsatisfactory.

SUMMARY OF THE INVENTION

According to the present invention, a surgical arm rest is provided to cushion, support and protect a patient's arms while the patient is in the prone position. The invention comprises an elongated member having a channel which extends substantially its entire length, the channel being shaped to accept the arm of the patient. The elongated member is tapered from its first end which is designed to fit under the upper arm of the patient to its second end which supports the lower arm and hand. The depth of the device at its first end is sufficient to raise the patient's shoulder slightly when placed under the patient's axilla and pectoral muscle. Elevating the shoulder joint relieves stretch on the brachial plexus, thus eliminating the complication of numbness in the hands which can develop into a bilateral wrist drop if the shoulders are allowed to droop through a long (5 or 6 hour) operation.

The arm rest according to the invention has an anatomically correct design and, in the preferred embodiment, is adapted to provide the anesthesiologist access to the patient's upper extremities for insertion or attachment of intravenous needles, tubes, and monitoring equipment.

In the middle of the arm rest, section is removed to allow the arm rest to bend at the patient's elbow. The removed section preferably has a V-shape and permits bending of the arm rest up to 90°. This not only allows the arm rest to be adapted to the natural, relaxed and slightly flexed position of the arm, but also permits the anesthesiologist to have access to the anticubical fossa of the patient.

A very common problem inherent in the prone position is pressure on the ulnar nerve. The surgical arm rest according to the present invention comfortably cushions the patient's elbow in order to prevent this injury and eliminate compression ulnar nerve palsy.

The preferred embodiment of the arm rest according to the present invention can be manufactured from any number of different foams such as polyurethane. The foam can be cut to shape or molded.

Thus, an object of the present invention is to provide an arm rest for cushioning, supporting and protecting the arm of a patient lying in the prone position. Other objects and features of the invention will become apparent to those of ordinary skill in the art in light of the following description and drawings of the preferred embodiment of the invention.

DESCRIPTION OF THE PREFERRED EMBODIMENT

Figure 1:
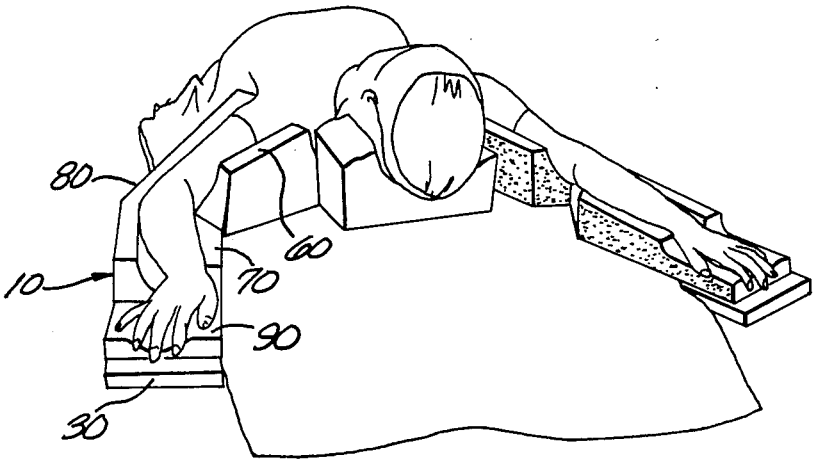
FIG. 1 is a perspective view of a patient lying in the prone position with both his right and left arms supported and protected by the preferred embodiment (right and left-handed) of the surgical arm rest according to the present invention.

Referring to FIG. 1, a patient is seen in the prone position with his right arm and left arm each supported by the preferred embodiment of the surgical arm rest according to the present invention. The head of the patient is supported by a separate face rest. (The face rest could be formed as part of the arm rest.) The prone position is the one assumed by patients during surgery on the back. The remainder of the discussion of the preferred embodiment will focus on the right-hand preferred embodiment of the surgical arm rest according to the present invention, it being understood that the left hand embodiment is the mirror image of the right. The right hand surgical arm rest preferred embodiment will be referred to generally by reference numeral 10.

Figure 2:
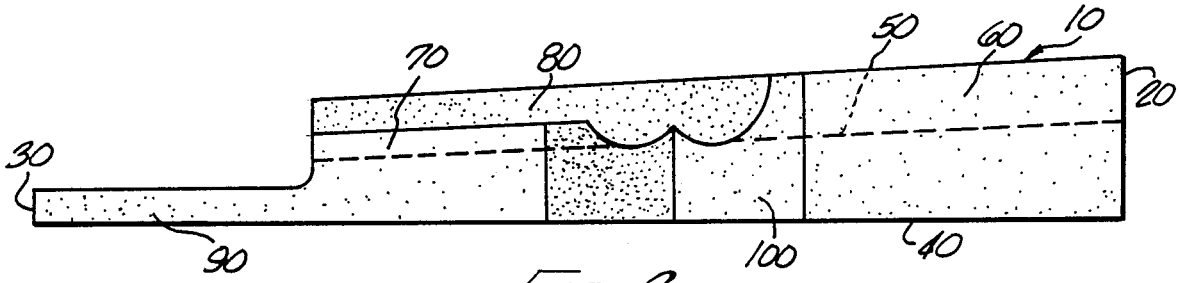
FIG. 2 is a plan view of one side of a right-handed preferred embodiment of the surgical arm rest according to the present invention.
Figure 4:
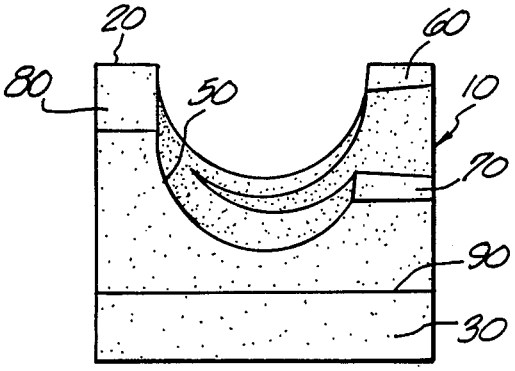
FIG. 4 is an end view of the right-handed preferred embodiment of the surgical arm rest according to the present invention.

Arm rest 10 is preferably formed from a single piece of foam rubber and generally comprises an elongated member having a first end 20 and a second end 30. As best seen in FIG. 2, arm rest 10 is tapered from its largest depth at first end 20 to its shallowest depth at second end 30. The bottom 40 of arm rest 10 is flat and is intended to rest on a surgical operating table or other flat surface upon which the patient is to lie in a prone position. The arm rest has inside ridges 60 and 70 and outside ridge 80 which define a semi-cylindrical channel 50 formed in the length of the arm rest 10. The U-shaped cross-section of channel 50 is best seen in FIG. 4. Channel 50 is intended to hold the length of the patient's arm securely and comfortably. Inside ridge 60 and 70 will be those ridges touching the inside of the patient's arm, and outside ridge 80 will be that ridge touching the outside of the patient's arm.

The thickness of the arm rest 10 at first end 20 is such that when placed under the patient's axilla and pectoral muscles it will elevate the shoulder joint and relieve stretch on the brachial plexus, thus eliminating the complications of numbness in the hands which can develop into a bilateral wrist drop if the shoulders are allowed to droop throughout a long (e.g., 5 to 6 hour) operation.

At second end 30 is a flat thin hand cushion 90 which serves as a support for the hand. Channel 50 terminates at hand cushion 90, at about the position of the wrist of the patient when the patient's arm is supported by the arm rest 10, as is best seen in FIG. 1.

Figure 3:
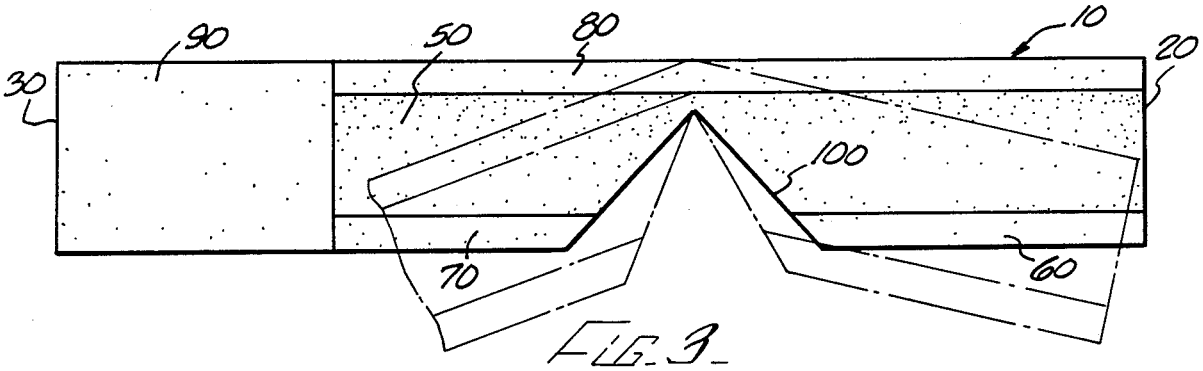
FIG. 3 is a plan view of the top of the right-handed preferred embodiment of the surgical arm rest according to the present invention, in solid line when straight and in phantom when bent, as in use.

In approximately the middle of the arm rest, through the inside ridge, is cut a V-shaped section 100. V-shaped section 100 is best observed in FIGS. 3 and 4. V-shaped section 100 allows the arm rest to bend at the patient's elbow up to 90° to permit the natural folding of the arm at the elbow when the patient is in the prone position, as may be observed in FIG. 1. The bending of the arm rest at V-shaped section 100 is best seen in FIG. 3, in which a part of the bent arm rest is shown in phantom.

The wide cut of V-shaped section 100 gives the attending anesthesiologist access to the anticubical fossa of the patient for insertion or attachment of intravenous needles, tubes, and monitoring equipment. For the same purpose, inside ridge 70 is also cut away to allow the anesthesiologist to have access to the forearm, wrist, and hand.

V-shaped section 100 could, of course, have shapes other than a V, and have a wider or narrower angle than 90°. A 90° V-shaped section is, however, preferred.

A problem inherent in the prone position is pressure on the ulnar nerve in the elbow. The arm rest described herein comfortably cushions the patient's elbow in order to prevent this injury and eliminate compression ulnar nerve palsy.

The preferred embodiment of the arm rest according to the invention may be manufactured from any of a number of different foams such as polyurethane. Foam is preferred because it is inexpensive, easily formed, comfortable for the patient, and disposable. It is also flexible enough to bend at the V-shaped section 100. The foam is preferably cut to shape rather than molded, as molding is a more expensive process.

Thus, the preferred embodiment of the invention has been illustrated and described with reference to the accompanying drawings. Those of skill in the art will understand that these preferred embodiments are by way of example only. Various changes and modifications may be made without departing from the spirit and scope of the invention, which is of the full breadth and scope of the appended claims.

What is claimed is:

1. A surgical arm rest for supporting and protecting a patient's arm while the patient is in the prone position, comprising an elongated member having a first end designed to be placed under the patient's upper arm and a second end designed to be placed under the patient's lower arm, said elongated member having ridges formed in it which define a U-shaped channel which extends substantially the entire length of said elongate member, said channel being shaped to accept the arm of the patient, said elongated member being tapered from said first end to said second end, said elongate member having sufficient depth of its first end such that when placed under the patient's upper arm it will slightly elevate the patient's shoulder joint, and in which a section of the elongated member at approximately its middle is removed to allow the elongated member to bend in order to accomodate the folding of the patient's arm at the elbow, and to permit access to the anticubical fossa of the patient.

2. The arm rest according to claim 1 in which said section is V-shaped.

3. The surgical arm rest according to claim 2 in which said second end of said elongate member includes a thin section which serves as a cushion for the patient's hand.

4. The surgical arm rest according to claim 3 in which the surgical arm rest is manufactured from a polyurethane foam.

5. A surgical arm rest for supporting and protecting a patient's arm when the patient is in the prone position, comprising an elongated member having a flat bottom, a first end to rest under the patient's axilla and pectoral muscle, and a second end to rest under the patient's lower arm, the elongated member having ridges formed along its upper edges which define a U-shaped channel shaped to accept the patient's arm therein, one ridge being an inside ridge and the other ridge being an outside ridge, a V-shaped section of at least the inside ridge being removed at approximately the middle of the elongated member to permit the elongated member to bend with the arm of the patient and to allow access to the anticubal fossa of the arm of the patient.

6. The arm rest according to claim 5 in which the inside ridge between the second end and the removed section is cut away to permit access to the forearm, wrist, and hand of the patient.

* * * * *